US007946461B2

(12) United States Patent
Wiley et al.

(10) Patent No.: US 7,946,461 B2
(45) Date of Patent: May 24, 2011

(54) AMPOULE OPENER AND ASSOCIATED METHODS

(75) Inventors: Jeffrey Lewis Wiley, Newton, NJ (US); Thomas Alan Halvorson, Hillsborough, NJ (US)

(73) Assignee: Watson Laboratories, Inc., Salt Lake City, UT (US)

( * ) Notice: Subject to any disclaimer, the term of this patent is extended or adjusted under 35 U.S.C. 154(b) by 510 days.

(21) Appl. No.: 11/449,144

(22) Filed: Jun. 5, 2006

(65) Prior Publication Data

US 2007/0282279 A1 Dec. 6, 2007

(51) Int. Cl.
*B67B 7/92* (2006.01)
*B26F 3/00* (2006.01)

(52) U.S. Cl. ..... 225/1; 225/93

(58) Field of Classification Search ..... 225/1, 93, 225/97, 103; 241/99; 30/164.9, 1.5; 229/93, 229/94, 96, 96.5, 105
See application file for complete search history.

(56) References Cited

U.S. PATENT DOCUMENTS

| | | | | | |
|---|---|---|---|---|---|
| 1,956,568 | A | * | 5/1934 | Fjord | 604/403 |
| 3,938,412 | A | | 2/1976 | Ushkow | |
| 3,999,451 | A | | 12/1976 | Ogle | |
| 4,226,376 | A | | 10/1980 | Pfleger | |
| 4,254,883 | A | | 3/1981 | Urban | |
| 4,353,869 | A | * | 10/1982 | Guth | 422/102 |
| 4,405,067 | A | | 9/1983 | Caron | |
| 4,405,069 | A | | 9/1983 | Vivier et al. | |
| 4,417,679 | A | | 11/1983 | Shields | |
| 4,506,817 | A | | 3/1985 | Parker | |
| 4,508,250 | A | | 4/1985 | Punchak | |
| 4,570,838 | A | | 2/1986 | Szemere et al. | |
| 4,637,139 | A | | 1/1987 | Chen | |
| 4,659,024 | A | * | 4/1987 | Frunzi et al. | 241/99 |
| 4,793,538 | A | | 12/1988 | Blomberg | |
| 4,805,821 | A | | 2/1989 | Kowalczyk et al. | |
| 4,896,649 | A | | 1/1990 | Rabenecker | |
| 5,080,271 | A | | 1/1992 | Chen | |
| 5,129,566 | A | | 7/1992 | Ogden et al. | |
| 5,601,128 | A | | 2/1997 | Furphy | |
| 5,628,353 | A | | 5/1997 | Ruther | |
| 5,800,113 | A | | 9/1998 | Yuyama et al. | |
| 5,961,021 | A | | 10/1999 | Koike et al. | |
| 6,244,487 | B1 | | 6/2001 | Murray | |
| 6,257,474 | B1 | | 7/2001 | Jones et al. | |
| 6,340,097 | B1 | | 1/2002 | D'Alessio et al. | |
| 6,478,191 | B1 | | 11/2002 | D'Alessio et al. | |
| 6,540,125 | B1 | * | 4/2003 | De Jongh | 225/93 |
| 6,712,252 | B2 | * | 3/2004 | Starr | 225/1 |
| 6,832,703 | B1 | | 12/2004 | Scott et al. | |
| 6,874,187 | B2 | | 4/2005 | Tague et al. | |

* cited by examiner

*Primary Examiner* — Ghassem Alie
(74) *Attorney, Agent, or Firm* — Florek & Endres PLLC

(57) ABSTRACT

An ampoule opener having a receiving body sized to accommodate a cap portion of an ampoule and a shield extending from the receiving body and being configured to lie adjacent a medicament storing portion of the ampoule when the cap portion of the ampoule is accommodated within the receiving body. The shield is rigidly related to the receiving body so as to be more resistive to bending relative to the receiving body in a direction away from a longitudinal axis of the receiving body than toward the longitudinal axis of the receiving body.

13 Claims, 4 Drawing Sheets

AMPOULE OPENER AND ASSOCIATED METHODS

FIELD OF THE INVENTION

The present invention relates generally to systems and methods for opening ampoules configured to contain medicaments and similar substances.

BACKGROUND OF THE INVENTION

A variety of liquid and powdered medicaments are packaged and delivered to users in ampoules formed from a single brittle material, most commonly glass. These types of ampoules generally include a neck portion reduced in size from a medicament storage portion. When it is desired to access the medicament, the ampoule is broken at the neck portion and a head or cap portion is removed from the ampoule to provide access to the medicament contained in the medicament storage portion. Because the ampoules are formed wholly from glass, opening the ampoules often causes sharp, sometimes jagged edges to be created at the location near the neck where the ampoules are broken open. These sharp edges can pose a risk that a user handling an opened ampoule may cut his or her hands while manipulating the opened ampoule.

In addition, as some degree of force is required on behalf of a user to open such ampoules, at the instant in time that the glass neck is "snapped" open the two resulting sections of the ampoule can both be subject to sudden movement. The sudden movement may cause medicament to be splashed out of the ampoule, posing a risk of adverse exposure to the user as well as a risk of lost or wasted medicament.

A variety of ampoule openers have been provided in the past, however many of these openers involve sophisticated designs that increase the complexity and cost of using such openers, and can reduce the likelihood that such openers will be used correctly. While relatively simplistic, hand-held openers have been provided, many of these do not address the safety issues inherent in manipulating newly open ampoule bodies with sharp and/or jagged exposed edges.

In addition, many conventional ampoule opening systems fail to provide a manner of safely handling and disposing of the cap of the ampoule that is removed from the medicament storage portion. As the cap can also exhibit sharp or jagged edges after being separated from the ampoule base, a user risks cutting his or her hands when handling or disposing of the cap.

SUMMARY OF THE INVENTION

Accordingly, the present invention provides an ampoule opener that addresses the above-recited issues. In one aspect, such an ampoule opener includes a receiving body sized to accommodate a cap portion of an ampoule and a shield extending from the receiving body. The shield can be configured to lie adjacent a medicament storing portion of the ampoule when the cap portion of the ampoule is accommodated within the receiving body. The shield can be rigidly related to the receiving body so as to be more resistive to bending relative to the receiving body in a direction away from a longitudinal axis of the receiving body than toward the longitudinal axis of the receiving body.

In accordance with another aspect of the invention, an ampoule opener is provided that includes a receiving body sized to accommodate a cap portion of an ampoule and a shield having a curvature corresponding to an outside curvature of the ampoule. The shield can extend from the receiving body and can be configured to lie adjacent a medicament storing portion of the ampoule when the cap portion of the ampoule is accommodated within the receiving body. An indicia viewing opening can be formed in a wall of the receiving body to allow a user to view indicia on the ampoule while the opener is disposed over the cap portion of the ampoule.

In accordance with another aspect of the invention, a method of opening an ampoule is provided, including: disposing a receiving body of an ampoule opener over a cap portion of the ampoule; aligning indicia viewing structure associated with the ampoule opener with indicia displayed on the ampoule; and applying force to the ampoule opener to cause the ampoule opener to disengage the cap portion of the ampoule from a medicament containing portion of the ampoule to thereby at least partially separate the cap portion of the ampoule from the medicament containing portion of the ampoule.

In accordance with another aspect of the invention, a method of protecting a user from harm while opening an ampoule is provided, including: disposing a receiving body of an ampoule opener over a cap portion of the ampoule; aligning a shield of the ampoule opener adjacent a portion of a neck of the ampoule that is to be broken; and applying force to the ampoule opener to cause the ampoule opener to disengage the cap portion of the ampoule from a medicament containing portion of the ampoule while rotating a distal portion of the shield of the ampoule opener away from the medicament containing portion of the ampoule to thereby at least partially separate the cap portion of the ampoule from the medicament containing portion of the ampoule.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
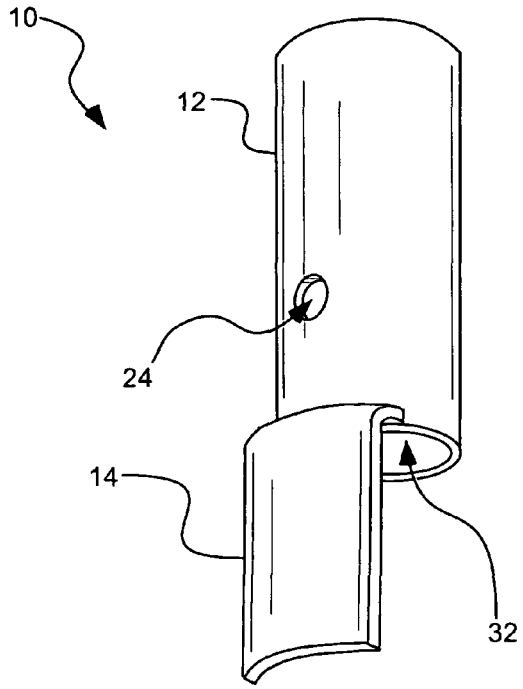
FIG. 1 is a perspective view of an ampoule opener in accordance with an embodiment of the present invention.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a "medicament" includes one or more of such medicaments.

Definitions

In describing and claiming the present invention, the following terminology will be used in accordance with the definitions set forth below.

As used herein, it is to be understood that two devices or components that are "rigidly related" to one another are sized, shaped and/or coupled to one another in a manner that restricts or limits bending or flexing of the components relative to one another. Two devices or components can be "rigidly related" to one another in a directional manner, such that bending or flexing of the components relative to one another is restricted or limited to a greater extent in one direction than in another direction. For example, in one aspect of the invention, a shield is rigidly related to a receiving body portion of an opener such that the shield is more resistive to bending relative to the receiving body in a direction away from a longitudinal axis of the receiving body than toward the longitudinal axis of the receiving body. Thus, while the shield may bend or flex relatively easily when urged (from a neutral position) toward the longitudinal axis of the receiving body, it is restricted or limited from bending or flexing when urged (from the neutral position) away from the longitudinal axis of the receiving body.

As used herein, the term "ampoule" generally refers to a variety of containers, generally formed from glass or a similar brittle material, that require a portion of the ampoule to be broken in order to access the contents of the ampoule. Ampoules discussed herein can contain a variety of medicaments in either liquid or powdered form. Ampoules discussed herein can also contain materials other than medicaments, to the extent that such materials are provided in ampoules formed of glass or other brittle materials.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 inch to about 5 inches" should be interpreted to include not only the explicitly recited values of about 1 inch to about 5 inches, but also include individual values and sub-ranges within the indicated range. This same principle applies to ranges reciting only one numerical value and should apply regardless of the breadth of the range or the characteristics being described.

Invention

Figure 3:
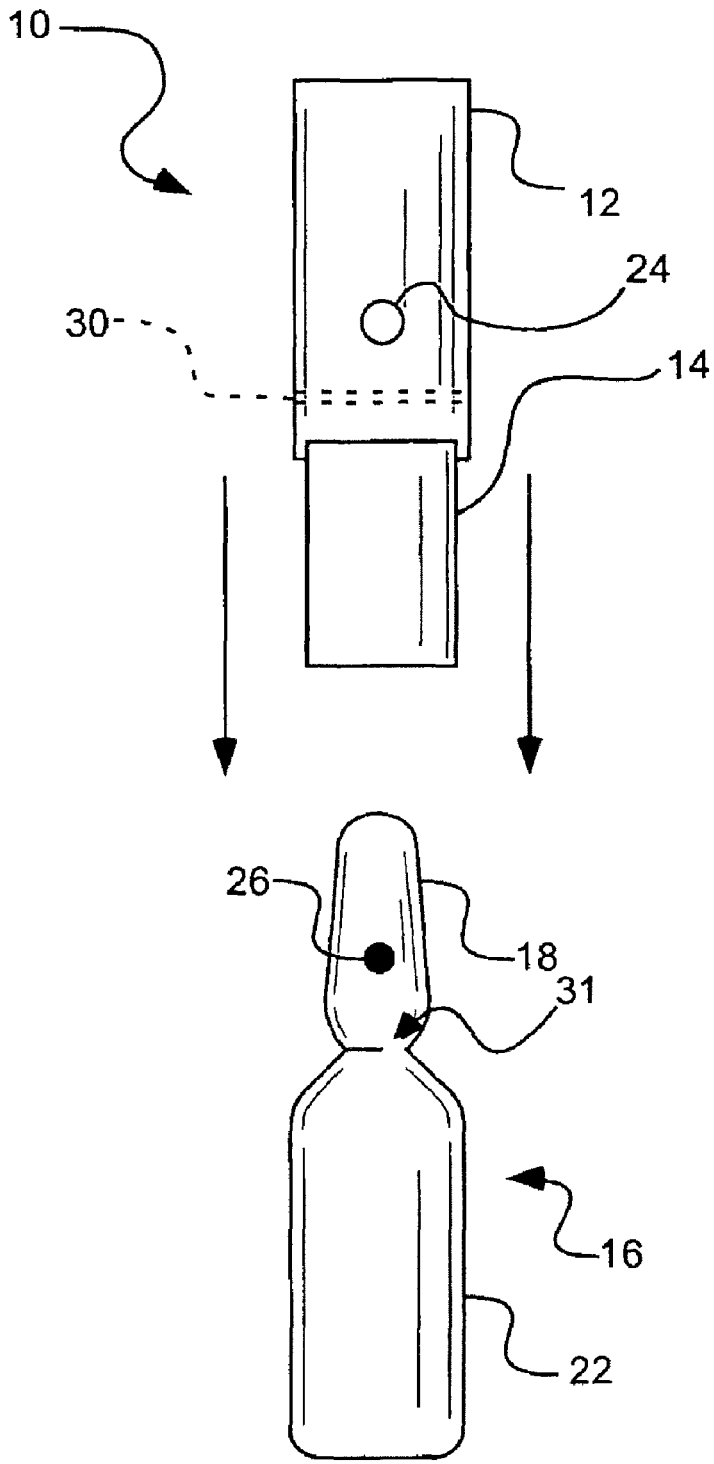
FIG. 3 is a plan view of the ampoule opener of FIG. 1 prior to it being attached to an exemplary ampoule.
Figure 4A:
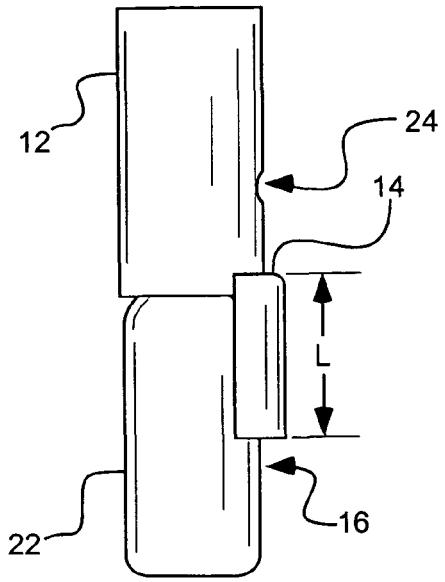
FIG. 4A is a plan view of the ampoule opener of FIG. 1 attached to the ampoule of FIG. 3 or FIG. 3A.
Figure 4B:
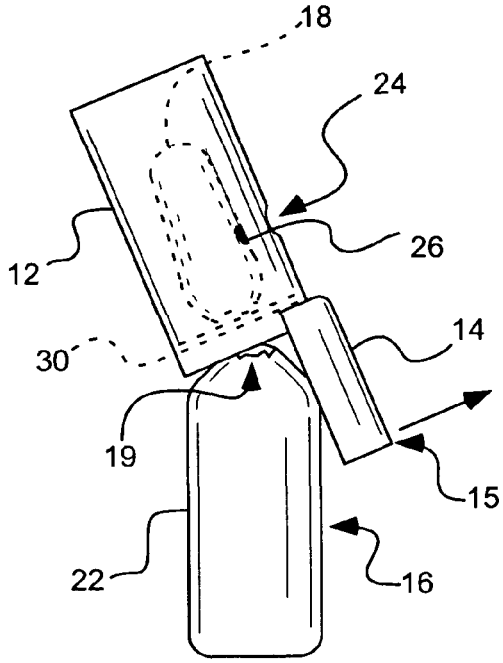
FIG. 4B is a plan view of the ampoule opener and ampoule of FIG. 4A, as the ampoule is being opened by the opener.
Figure 4C:
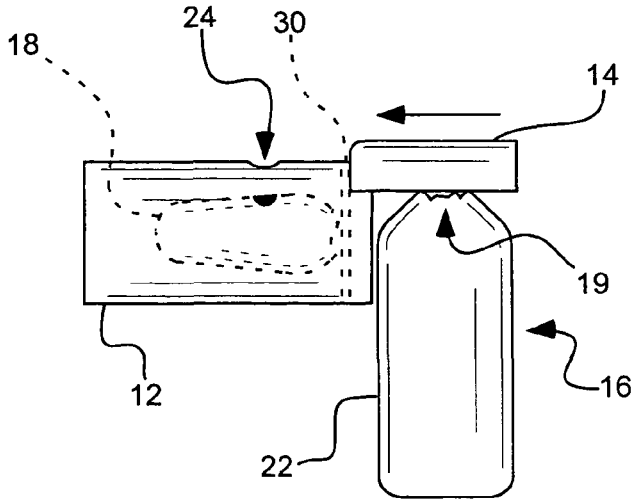
FIG. 4C is a plan view of the ampoule opener and ampoule of FIG. 4A, as the opener containing a cap of the ampoule is being separated from a lower portion of the ampoule.

As illustrated generally in the attached figures, in one aspect of the present invention, an ampoule opener 10 is provided for use in opening commonly available ampoules (one such exemplary ampoule being shown at 16 in FIG. 3-FIG. 4C). The ampoule opener can include a receiving body 12 sized to accommodate a cap portion 18 of the ampoule. A shield 14 can extend from the receiving body and can be configured to lie adjacent a medicament storing portion 22 of the ampoule when the cap portion of the ampoule is accommodated within the receiving body of the opener. The shield can be rigidly related to the receiving body so as to be resistive to bending relative to the receiving body in at least one direction. As discussed in more detail below, by forming the shield from a relatively rigid material, and having it extend from the receiving body in a relatively rigid manner, the shield can serve to protect a user from being cut by sharp edges of an open ampoule, and from contact with splashed or otherwise inadvertently spilled medicament.

The shield 14, when in the neutral position shown in FIG. 1, can be more resistive to bending away from a longitudinal axis (shown schematically by element 37 of FIGS. 2A and 2B) than toward the longitudinal axis. Thus, while the shield may bend or flex relatively easily when urged (from the neutral position) toward the longitudinal axis of the receiving body, it is restricted or limited from bending or flexing when urged (from the neutral position) away from the longitudinal axis of the receiving body.

In use, the opener 10 is positioned over the cap portion 18 of the ampoule 16, as shown in FIG. 3. The opener 10 can then be lowered onto the cap portion, into the relationship illustrated in FIG. 4A. A user can then orient the shield in a desired position relative to the user (e.g., facing away from or toward the user), and can then apply a force to the opener to cause the opener to rotate relative to the medicament containing portion of the ampoule, thereby causing the ampoule to fracture at the neck of the ampoule. Generally, the force applied by the user will cause a distal portion (15 in FIG. 4B) of the shield 14 to rotate or move away from the lower, medicament containing portion of the ampoule. In one embodiment, rotating the distal portion of the shield away from the medicament containing portion of the ampoule includes also rotating or moving the distal portion away from a user opening the ampoule. In other words, in one embodiment of the invention, the shield is oriented away from the user and the opener is pulled toward the user when opening the ampoule.

After the neck portion of the ampoule 10 is cracked or snapped, the user can continue the process by sliding the shield 14 across the compromised portion (e.g., the fractured surface 19 in FIG. 4C) of the lower, medicament containing portion 22 of the ampoule 10. In this manner, the user can avoid being cut by the compromised portion as the cap portion and the lower portion are separated from one another. As the shield is limited or restricted from bending or flexing away from the longitudinal axis 37 of the receiving body 12, the shield will not bend backwardly as the shield is moved across the compromised portion of the opened ampoule. Were the shield allowed to bend backwardly, the protective benefit provided by the shield may be limited, or negated altogether. The present opener thus advantageously limits bending of the shield in a direction most beneficial to the safety of the user.

While the above-described steps are shown in the figures as discrete events, it will be appreciated that the instance of "snapping," "cracking," or otherwise separating the cap and lower portions of the ampoule can occur very suddenly or quickly. By directing the force applied to the opener during the opening process so that the fractured surface 19 of the lower portion (created when the ampoule is broken) is directed toward, or actually contacts, the shield 14, the user can ensure that his or her finger or hand that is in contact with the opener is not cut by the potentially very sharp edges of the fractured surface 19. The shield can also help deflect any medicament accidentally splashed out of the lower portion during, or immediately after, separation of the cap portion from the lower portion.

Figure 2A:
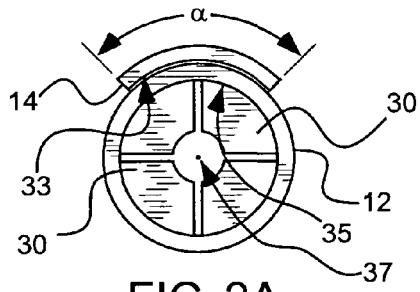
FIG. 2A is a bottom view of the ampoule opener of FIG. 1.
Figure 2B:
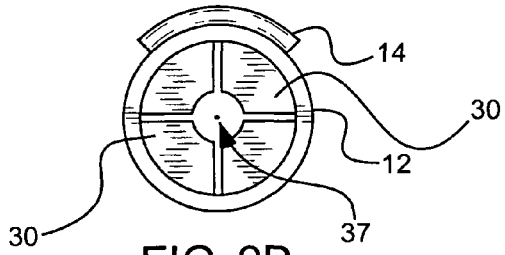
FIG. 2B is a top view of the ampoule opener of FIG. 1.

As best appreciated from FIG. 1-FIG. 2B, in one aspect of the invention the shield 14 can include a curvature that generally corresponds to an outside curvature of the lower, medicament containing portion 22 of the ampoule 16. In this manner, the shield can be sized so as to guard a relatively large circumferential area adjacent the neck of the ampoule without extending laterally beyond the sides of the ampoule. While the shield can be sized and/or shaped to extend circumferentially about the lower portion of the ampoule (and, accordingly, about the receiving body of the opener) to a variety of degrees, in one aspect of the invention the shield extends about the lower portion of the ampoule in an arc of about 45°, as shown for example by angle $\alpha$ in FIG. 2A. In other aspects of the invention, the shield can extend circumferentially about the lower portion by an angle of about 90°.

The curvature of the shield 14 can add rigidity to the shield to ensure that the shield does not easily deflect when contacting the fractured surface 19 of the lower, medicament containing portion 22 of the ampoule immediately after breakage of the neck of the ampoule. While the material from which the opener is formed can vary, in one aspect of the invention is formed from a relatively lightweight polymer such as low density polyethylene (LDPE). While such materials exhibit some rigidity in the thicknesses at which the shield is formed (generally on the order of about ⅛ of an inch), the shield may be subject to some degree of bending if formed in a flat, planar configuration and not otherwise reinforced. By forming the shield with a curvature that corresponds to the curvature of the ampoule, the shield can exhibit the rigidity necessary to provide protection to a user opening an ampoule with the opener.

In one aspect of the invention, the shield 14 extends only partially about the lower portion 22 of the ampoule 10. In this manner, the shield does not extend onto the sides of the lower portion of the ampoule near the "pivot" point of the opener, so as to avoid interference with rotation or angling of the opener relative to the lower portion of the ampoule. The shield can extend downward for a variety of lengths (shown by example at "L" in FIG. 4A), and in one embodiment extends for a distance L of about ½ an inch.

Figure 3A:
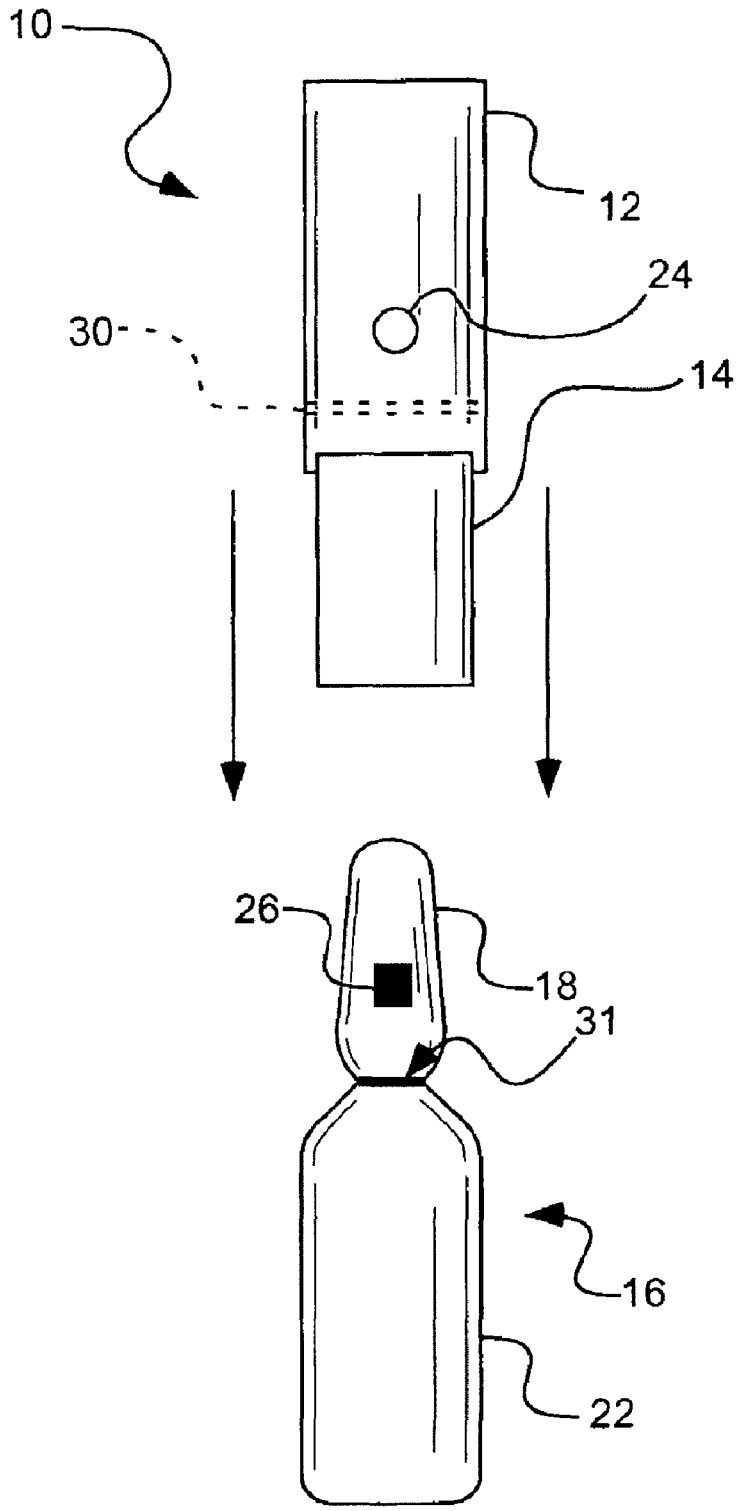
FIG. 3A is a plan view of another embodiment of the ampoule opener of FIG. 1 prior to it being attached to an exemplary ampoule.

As best appreciated from FIG. 3, FIG. 3A and FIG. 4A-FIG. 4C, in one aspect of the invention, the opener 10 can include indicia viewing structure 24 associated with the opener. The indicia viewing structure can be operative to allow a user to view indicia 26 displayed on or by the ampoule 16 while the opener is disposed over the cap portion of the ampoule. A variety of indicia viewing structure can be provided, and in one embodiment an opening can be formed in a wall of the receiving body 12 to allow a user to view the indicia on the ampoule. In one aspect of the invention, the indicia displayed on or by the ampoule can comprise a circle or a dot printed or painted on the cap portion 18 of the ampoule. The indicia viewing structure can include a generally circular opening that the user can align over the circle or dot. As best shown in FIG. 3A, the indicia viewing structure may also be of a different shape than the indicia displayed on or by the ampoule.

This aspect of the invention can be particularly advantageous when the ampoule is provided with a neck portion that is at least partially scored to aid in opening the ampoule. For example, as shown in FIG. 3, a portion 31 of the neck of the ampoule on the same side as the indicia 26 can be partially scored. By only scoring a portion of the neck, accidental opening of the ampoule can be reduced, in contrast with ampoules that are scored completely about the neck of the ampoule. As only a portion of the neck of the ampoule is scored, the indicia and indicia viewing structure can be utilized to ensure that force applied by a user when opening the ampoule is correctly aligned to apply to a separating force to that scored portion. In this manner, the user can best make use of the design of the ampoule scoring.

While not so required, in one aspect of the invention, the indicia viewing structure 24 can be aligned with a circumferential midpoint of the shield. In this manner, when the indicia viewing structure is aligned with the indicia 26, the shield is automatically positioned to protect the area of the ampoule that will most likely be opened first, e.g., the scored portion of the ampoule neck. In addition, as best shown in FIG. 2A and FIG. 2B, the shield 14 can extend coaxially with the receiving body 12 and can include an inner surface 33 that is offset radially outwardly from an inner surface 35 of the receiving body. In this manner, the size of the inner surface of the receiving body (and, accordingly, the size of the cavity 32 of the receiving body) can be tailored to match the size of the ampoule cap 18 independently of the size and curvature of the shield, which will generally match the size and curvature of the lower, medicament containing portion 22 of the ampoule.

As also best appreciated from FIGS. 2A, 2B, 4B and 4C, in one aspect of the invention the ampoule opener 10 can include retaining means 30 for retaining the cap portion 18 of the ampoule within the receiving body 12 of the ampoule opener. While the retaining means can include a variety of structure suitable for retaining the cap within the receiving body, in one embodiment, the retaining means includes at least one retaining flap 30 extending from an internal wall or surface 35 of the receiving body into the cavity 32 (FIG. 1) of the receiving body. The retaining flaps can be formed of a relatively flexible material (or at a thickness that provides flexibility) to allow the cap portion of the ampoule to pass into the cavity of the receiving body. After the largest section of the cap portion passes beyond the retaining flaps into the cavity, the flaps can fold back into the generally orthogonal relationship with the internal wall of the receiving body and thereby resist movement of the cap portion from the receiving body.

The retaining means can be particularly advantageous in handling and disposing of the cap portion 18 of the ampoule 10 after the cap portion has been removed from the lower, medicament containing portion 22 of the ampoule. In most cases, the cap portion will be held within the cavity of the receiving body by the retaining flaps as soon as the cap portion is separated from the lower portion of the ampoule. In this manner, a user need never handle the cap portion after it has been removed, and can simply discard the opener 10 containing the cap portion in an appropriate manner.

As will be appreciated from the above disclosure, the present invention can provide a method of opening an ampoule, comprising: disposing a receiving body of an ampoule opener over a cap portion of the ampoule; aligning indicia viewing structure associated with the ampoule opener with indicia displayed on the ampoule; and applying force to the ampoule opener to cause the ampoule opener to disengage the cap portion of the ampoule from a medicament containing portion of the ampoule to thereby at least partially separate the cap portion of the ampoule from the medicament containing portion of the ampoule.

The method can further include drawing the ampoule opener toward a user opening the ampoule while covering a compromised portion of the ampoule with the shield. The method can further include aligning indicia viewing structure associated with the opener with indicia disposed on the ampoule while the opener is disposed over the cap portion of the ampoule. The indicia viewing structure can include an opening formed in a wall of the receiving body.

The method can further include retaining the cap portion of the ampoule within the receiving body of the ampoule opener after the cap portion is separated from the medicament containing portion of the ampoule.

A method of protecting a user from harm while opening an ampoule can also be provided, comprising: disposing a receiving body of an ampoule opener over a cap portion of the ampoule; aligning a shield of the ampoule opener adjacent a portion of a neck of the ampoule that is to be broken; and applying force to the ampoule opener to cause the ampoule opener to disengage the cap portion of the ampoule from a medicament containing portion of the ampoule while rotating a distal portion of the shield of the ampoule opener away from the medicament containing portion of the ampoule to thereby at least partially separate the cap portion of the ampoule from the medicament containing portion of the ampoule.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. An ampoule opener, comprising:

a) a receiving body sized to accommodate a cap portion of an ampoule;

b) a shield having a curvature corresponding to an outside curvature of an ampoule and being rigidly related to the receiving body so as to be more resistive to bending relative to the receiving body in a direction away from a longitudinal axis of the receiving body than toward the longitudinal axis of the receiving body, the shield adjacent to and extending from the receiving body and being configured to lie adjacent and extend partially circumferentially about a medicament storing portion of an ampoule when a cap portion of an ampoule is accommodated within the receiving body;

c) indicia viewing structure comprising an opening formed in a wall of the opener, the indicia viewing structure being operative to allow a user to view indicia on a cap portion of an ampoule while the opener is disposed over a cap portion of an ampoule thereby facilitating correct alignment of the opener with an ampoule; and d) a retaining means for retaining a cap portion of an ampoule within the receiving body, wherein the retaining means is located between the indicia viewing structure and the shield.

2. The opener of claim 1, wherein the indicia viewing structure is aligned with a circumferential midpoint of the shield.

3. The ampoule opener of claim 1 wherein the shield extends circumferentially about a medicament storing portion of an ampoule in an arc of about 45°.

4. The ampoule opener of claim 1 wherein the shield extends circumferentially about a medicament storing portion of an ampoule in an arc of about 90°.

5. The ampoule opener of claim 1 wherein the shield extends from the receiving body for a distance of about 0.5 inches.

6. The ampoule opener of claim 1 wherein the indicia viewing structure is generally circular.

7. The ampoule opener of claim 1 wherein the retaining means comprises at least one retaining flap.

8. The ampoule opener of claim 1 wherein the indicia viewing structure and the indicia on the ampoule are of the same shape.

9. The ampoule opener of claim 1 wherein the indicia viewing structure and the indicia on the ampoule are different shapes.

10. The ampoule opener of claim 1 wherein the indicia on the ampoule is a circle or a dot.

11. The ampoule opener of claim 1 wherein the neck portion of the ampoule is fully scored.

12. The ampoule opener of claim 1 wherein a neck portion of the ampoule is partially scored.

13. The ampoule opener of claim 12 wherein the partial score and the indicia are on the same side of the ampoule.

* * * * *